US009530377B2

(12) United States Patent
Hsu et al.

(10) Patent No.: US 9,530,377 B2
(45) Date of Patent: Dec. 27, 2016

(54) DISCHARGING CONTROL METHOD, RELATED DRIVING METHOD AND DRIVING DEVICE

(71) Applicant: NOVATEK Microelectronics Corp., Hsin-Chu (TW)

(72) Inventors: Chin-Hung Hsu, Taoyuan (TW); I-Chun Kuo, Miaoli County (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 58 days.

(21) Appl. No.: 14/720,985

(22) Filed: May 26, 2015

(65) Prior Publication Data

US 2016/0071477 A1 Mar. 10, 2016

(30) Foreign Application Priority Data

Sep. 5, 2014 (CN) ..... 2014 1 0453768

(51) Int. Cl.
*G09G 3/36* (2006.01)

(52) U.S. Cl.
CPC ..... *G09G 3/3696* (2013.01); *G09G 3/3648* (2013.01); *G09G 2310/0278* (2013.01); *G09G 2320/0257* (2013.01); *G09G 2330/021* (2013.01); *G09G 2330/027* (2013.01)

(58) Field of Classification Search
CPC ..... G09G 2330/027; G09G 2320/0257; G09G 2330/021; G09G 3/3648
See application file for complete search history.

(56) References Cited

U.S. PATENT DOCUMENTS

2008/0049000 A1* 2/2008 Kim ..... G09G 3/3677 345/204

* cited by examiner

*Primary Examiner* — Gerald Johnson
(74) *Attorney, Agent, or Firm* — Winston Hsu; Scott Margo

(57) ABSTRACT

A discharging-control method, for a display system drove by a power and comprising a panel with a plurality of pixels and a gate driving module, wherein the gate driving module generates a plurality of gate driving signals according to gate-high voltage and gate-low voltage and the plurality of gate driving signals is switched between the gate-high voltage and the gate-low voltage for switching the conducting statuses of a plurality of transistor switches of the plurality of pixels, includes switching the plurality of gate driving signals to the gate-low voltage in a power-off period, wherein the power is turned off in the power-off period; and generating at least one raising voltage at a receiving path of the gate-low voltage or a plurality of output paths of the plurality of gate driving signals, for raising the voltage level of the plurality of gate driving signals and conducting the plurality of transistor switches.

8 Claims, 6 Drawing Sheets

DISCHARGING CONTROL METHOD, RELATED DRIVING METHOD AND DRIVING DEVICE

BACKGROUND OF THE INVENTION

1. Field of the Invention

The present invention relates to a discharging control method, related driving method and driving device, and more particularly, to a discharging control method capable of clearing blur without additional control signals, related driving method and driving device.

2. Description of the Prior Art

A liquid crystal display (LCD) is a flat panel display which has the advantages of low radiation, light weight and low power consumption and is widely used in various information technology (IT) products, such as notebook computers, personal digital assistants (PDA), and mobile phones. An active matrix thin film transistor (TFT) LCD is the most commonly used transistor type in LCD families, and particularly in the large-size LCD family. A driving system installed in the LCD includes a timing controller, source drivers and gate drivers. The source and gate drivers respectively control data lines and scan lines, which intersect to form a cell matrix. Each intersection is a cell including crystal display molecules and a TFT. In the driving system, the gate drivers are responsible for transmitting scan signals to gates of the TFTs to turn on the TFTs on the panel. The source drivers are responsible for converting digital image data, sent by the timing controller, into analog voltage signals and outputting the voltage signals to sources of the TFTs. When a TFT receives the voltage signals, a corresponding liquid crystal molecule has a terminal whose voltage changes to equalize the drain voltage of the TFT, which thereby changes its own twist angle. The rate that light penetrates the liquid crystal molecule is changed accordingly, allowing different colors to be displayed on the panel.

When the LCD is turned off, parts of the image displayed by the LCD may persist on the LCD if the drain voltages used for controlling the liquid crystal molecules is not immediately cleared. In order to clear the remain images (i.e. blur), the prior art may utilize additional control signals to reset the drain voltages used for controlling the liquid crystal molecules, which increases the number of signal lines and the hardware cost of the control circuit in the LCD. Thus, how to reset the drain voltage used for controlling the liquid molecules when the LCD is turned off becomes a topic to be discussed.

SUMMARY OF THE INVENTION

In order to solve the above problem, the present invention provides a discharging control method capable of clearing blur without addition control signals, related driving method and driving device.

As an aspect, the present invention discloses a blur-clearing method for a display system, which is drove by a power and comprises a panel with a plurality of pixels and a gate driving module. The gate driving module generates a plurality of gate driving signals according to a gate-high voltage and a gate-low voltage and the plurality of gate driving signals is switched between the gate-high voltage and the gate-low voltage in a normal operation period, wherein the power is turned on in the normal operation period. The display system is utilized for switching the conducting statuses of a plurality of transistor switches of the plurality of pixels. The discharging control method comprises switching the plurality of gate driving signals to the gate-low voltage in a power-off period, wherein the power is turned off in the power-off period; and generating at least one raising voltage at a receiving path of the gate-low voltage or a plurality of output paths of the plurality of gate driving signals, for raising the voltage level of the plurality of gate driving signals and conducting the plurality of transistor switches.

As another aspect, the present invention discloses a driving method for a display system drove by a power. The driving method comprises generating a plurality of gate driving signals according to a gate-high voltage and a gate-low voltage; maintaining the gate-high voltage and the gate-low voltage and switching each of the plurality of gate driving signals between the gate-high voltage and the gate-low voltage in a normal operation period, wherein the power is turned on in the normal operation period, for switching conducting statuses of a plurality of transistor switches coupled to a plurality of pixels of a panel in the display system; and switching the plurality of gate driving signals to the gate-low voltage and generating at least one raising voltage at a receiving path of the gate-low voltage or a plurality of output paths of the plurality of gate driving signals in a power-off period, wherein the power is turned off, for raising the voltage levels of the plurality of gate driving signals and conducting the plurality of transistor switches.

As another aspect, the present invention discloses a driving device for a display system drove by a power. The driving device comprises a gate driving module and at least one discharging control module. The gate driving module is utilized for generating a plurality of gate driving signals according to a gate-high voltage and a gate-low voltage, to control a plurality of transistor switches coupled to a plurality of pixels in a panel of the display system. Each discharging control module comprises an electricity storage unit, coupled between a positive voltage and a ground voltage of the display system for generating a charging voltage; and a switch, coupled between the electricity storage unit and an output end of the discharging control module for switching a connection between the charging voltage and the output end according to the positive voltage, to generate a raising voltage on the plurality of gate driving signals.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
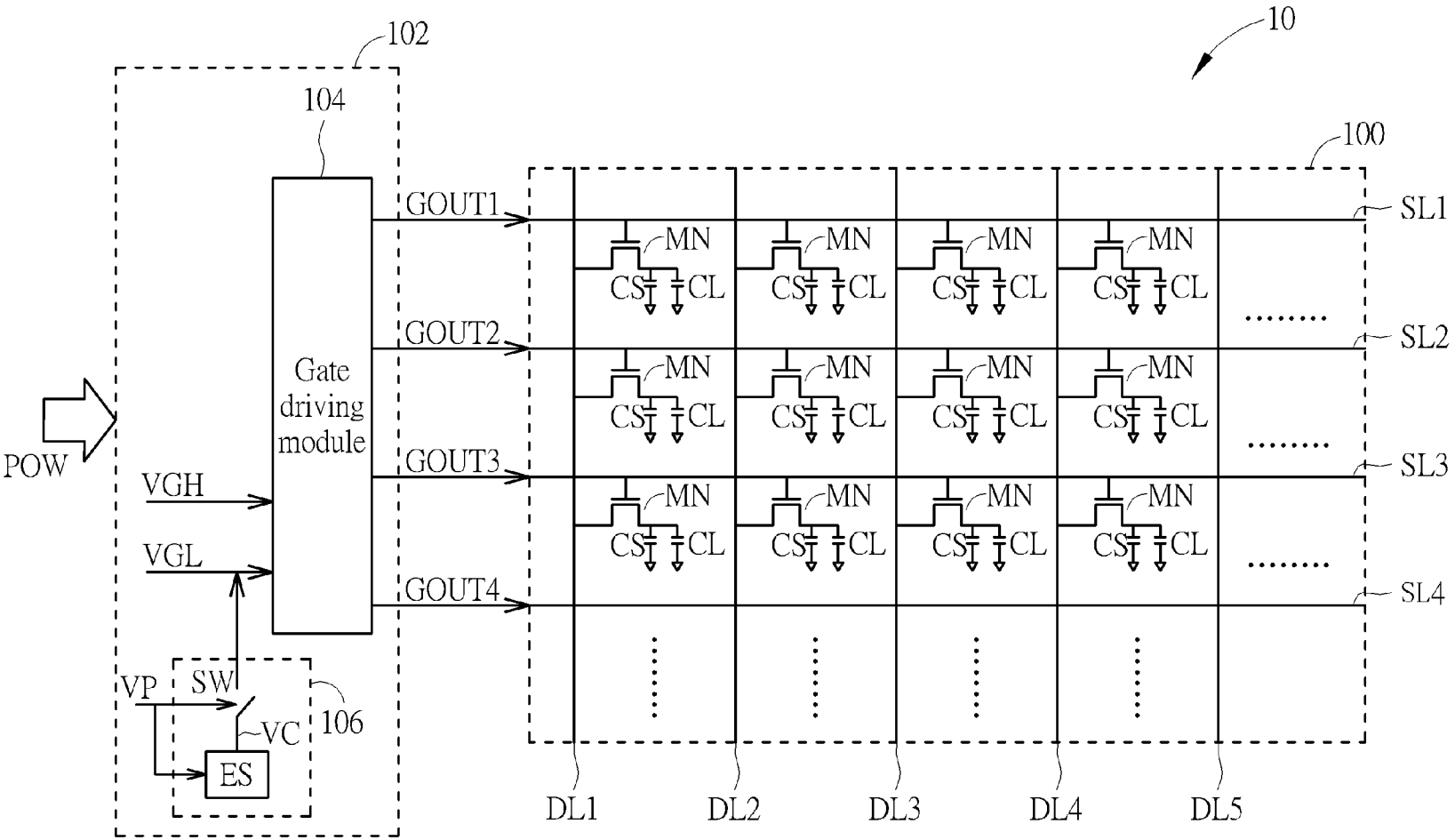
FIG. 1 is a schematic diagram of a display system according to an embodiment of the present invention.

Please refer to FIG. 1, which is a schematic diagram of a display system 10 according to an example of the present invention. The display system 10 may be an electronic product, such as a thin film transistor (TFT) liquid crystal display (LCD), a mobile phone, a laptop, or a tablet and the detailed structure of the display system 10 varies with different applications. In FIG. 1, the display system 10 comprises a panel 100 and a driving device 102. In order to simplify illustrations, FIG. 1 only shows a gate driving module 104 and a discharging control module 106 and the components not directly related to the concept of the present invention (e.g. a source driving module, a voltage generating module, computing circuits and connection interfaces) are omitted. As shown in FIG. 1, the display system 10 is drove by a power POW. The panel 100 comprises scan lines SL1-SLn and data lines DL1-DLm. Note that, FIG. 1 shows the scan lines SL1-SL4 and the data lines DL1-DL5 for illustrations. Each of intersections between the scan lines SL1-SLn and the data lines DL1-DLm equips a transistor MN which is coupled to one of the scan lines SL1-SLn, one of the data lines DL1-DLm and capacitors CS and CL. The capacitor CL may be an equivalent capacitor of a display component, such as a liquid crystal molecule. The operation principle of the panel 100 should be well-known to those with ordinary skill in the art, and is not described herein for brevity. The gate driving module 104 is utilized for generating gate driving signals GOUT1-GOUTn according to a gate-high voltage VGH and a gate-low voltage VGL, to control the conducting status of each of the transistors MN. The discharging control module 106 is utilized for generating a raising voltage VR to the gate-low voltage VGL in a power-off period, wherein the display system is turned off, to conduct all of the transistors MN and to clear the voltages across the capacitors CS and CL (i.e. the voltages across the display components). Via adding the discharging control module 106, the display system 10 clears the voltages across the capacitors CS and CL without additional control signals. The number of signal lines among the circuits of the display system 10 is decreased and the complexity of signal line routing is lowered, therefore.

In details, the discharging control module 106 comprises an electricity storage unit ES and a switch SW. The electricity storage unit ES is coupled between a positive voltage VP and the ground GND for generating a charging voltage VC. The positive voltage VP may be any one voltage with a positive polarity in the display system 10. The switch SW is coupled between the charging voltage VC and the gate-low voltage VGL for controlling a connection between the charging voltage VC and the gate-low voltage VGL according to the positive voltage VP. In a normal operation period, wherein the power POW coupled to the display system 10 is turned on, the gate driving module 104 switches the gate driving signals GOUT1-GOUTn between the gate-high voltage VGH and the gate-low voltage VGL to sequentially conduct the transistors MN. In the normal operation period, the electricity storage unit ES begins to store charges via the positive voltage VP for increasing the charging voltage VC and the switch SW disconnects the connection between the charging voltage VC and the gate-low voltage VGL. In the power-off period, wherein the power POW is turned off, the gate driving module 104 switches the gate driving signals GOUT1-GOUTn to the gate-low voltage VGL. In addition, the voltages of the positive voltage VP, the gate-high voltage VGH and the gate-low voltage VGL become that of the ground GND since the power POW is turned off. In such a condition, the switch SW conducts the connection between the charging voltage VC and the gate-low voltage VGL, such that the gate-low voltage VGL is charged by the charging voltage VC and is raised to the raising voltage VR in a clearing period, to conduct the transistors MN coupled to the scan lines SL1-SLn. In the clearing period, the voltages of the data lines DL1-DLm also become that of the ground GND, thus the voltages across the display components is cleared when the transistors MN coupled to the scan lines SL1-SLn is conducted. In other words, the discharging control module 106 generates the raising voltage VR at a receiving path of the gate-low voltage VGL in the clearing period, to raise the voltage levels of the gate driving signals GOUT1-GOUTn and conduct all the transistors MN. That is, the display system 10 clears the images remaining on the panel 100 without additional signal lines.

Figure 2:
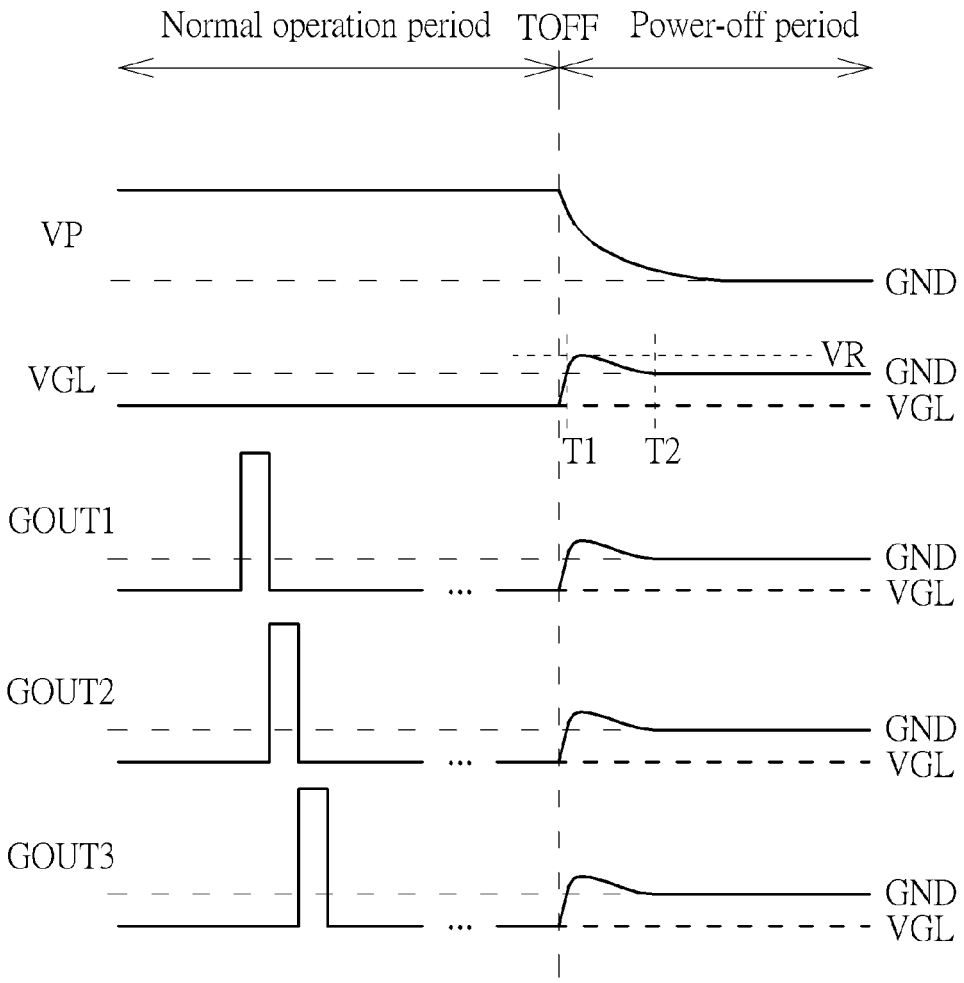
FIG. 2 is a schematic diagram of related signals when the display system shown in FIG. 1 operates.

Please refer to FIG. 2, which is a schematic diagram of related signals when the display system 10 shown in FIG. 1 operates. In order to simplify illustrations, FIG. 2 only shows the gate driving signals GOUT1-GOUT3. As shown in FIG. 2, the power POW is turned on and the display system 10 performs the normal operations before a time TOFF (i.e. the display system 10 operates in the normal operation period). The gate driving module 104 sequentially generates pulses, which is from the gate-low voltage VGL to the gate-high voltage VGH, on the gate driving signals GOUT1-GOUTn, to sequentially conduct the transistors MN coupled to the scan lines SL1-SLn. After the time TOFF, the power POW is turned off and the display system 10 shuts down (i.e. the display system 10 operates in the power-off period). The gate driving module 104 switches the gate driving signals GOUT1-GOUTn to be coupled to the gate-low voltage VGL, resulting that the gate driving signals GOUT1-GOUTn starts increasing from the gate-low voltage VGL to the voltage of the ground GND. In addition, the positive voltage VP begins decreasing to the voltage of the ground GND at the same time. At a time T1, the positive voltage VP decreases to a threshold voltage VTH and controls the switch SW to conduct the connection between the charging voltage VC and the gate-low voltage VGL. In such a condition, the gate-low voltage VGL is gradually raised to the raising voltage VR, the transistors MN coupled to the scan lines SL1-SLn are conducted, and the voltages across the display components is cleared. At a time T2, the charges stored in the electricity storage unit ES run out and the gate-low voltage VGL decreases to the voltage of the ground GND. Note that, the period between the times T1 and T2 is corresponding to the above clearing period. According to the above, the display system 10 clears the blur on the panel 100 without additional signal lines.

Figure 3:
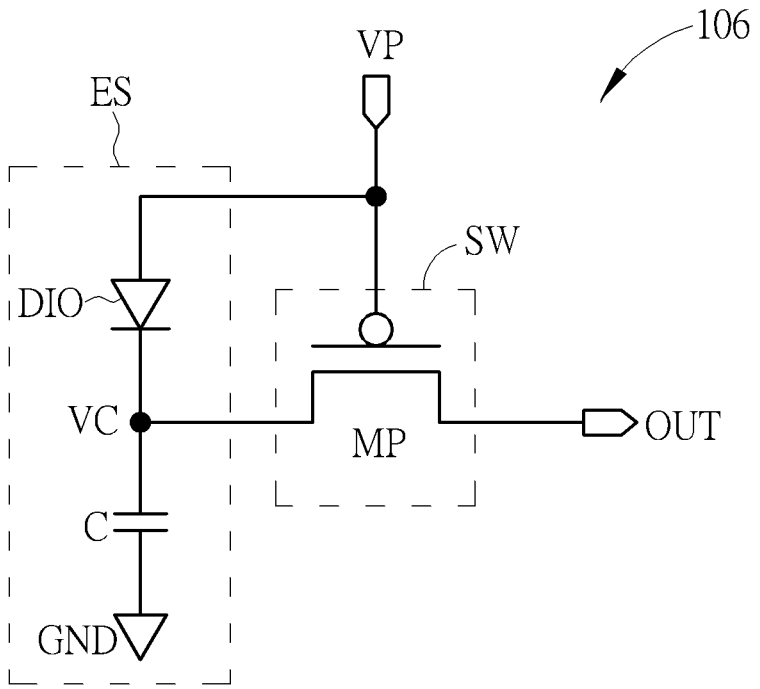
FIG. 3 is a schematic diagram of an implementation of the discharging control module shown in FIG. 1.

According to different applications and design concepts, the discharging control module 106 can be realized by various methods. Please refer to FIG. 3, which is a schematic diagram of an implementation of the discharging control module 106 shown in FIG. 1. In this example, the electricity storage unit ES comprises a diode DIO and a capacitor C, wherein an anode of the diode DIO is coupled to the positive voltage VP and the capacitor C is coupled between the charging voltage VC and the ground GND. The switch SW is realized by a transistor MP, wherein a drain and a source of the transistor MP are coupled to the charging voltage VC and an output end OUT, respectively. When the power POW is turned on and the display system 10 performs the normal operations, the positive voltage VP turns off the transistor MP and charges the capacitor C via the diode DIO. When the power POW is turned off and the display system 10 shuts down, the voltage of positive voltage VP gradually decreases to that of the ground GND and stops charging the capacitor C. When a voltage difference between the positive voltage VP and the charging voltage VC is smaller than a threshold voltage of the transistor MP, the transistor MP is conducted and the charging voltage VC is outputted to the output end OUT. If the output end OUT is coupled to the gate-low voltage VGL, the charging voltage VC increases the gate-low voltage VGL to raise the gate-low voltage VGL to the raising voltage VR within the clearing period.

The above embodiments utilize the charges, which is stored while performing the normal operations, to conduct the transistors coupled to the scan lines when the display system shuts down and to clear the voltages across the display components and the image remaining on the panel of the display system. According to different application and design concepts, those with ordinary skill in the art may observe appropriate alternations and modifications. For example, the discharging control module 106 may be configured in different circuits. In an example, the discharging control module 106 may be configured in the gate driving module 104. In another example, the discharging control module 106 may be configured in a source driving module of the display system 10. In still another example, the discharging control module 106 may be configured in a voltage generating module (e.g. a dc-dc converting module) of the display system 10, wherein the voltage generating module is utilized for generating the voltages required by the operations of the display system 10 (e.g. the gate-high voltage VGH, the gate-low voltage VGL and the positive voltage VP).

Figure 4:
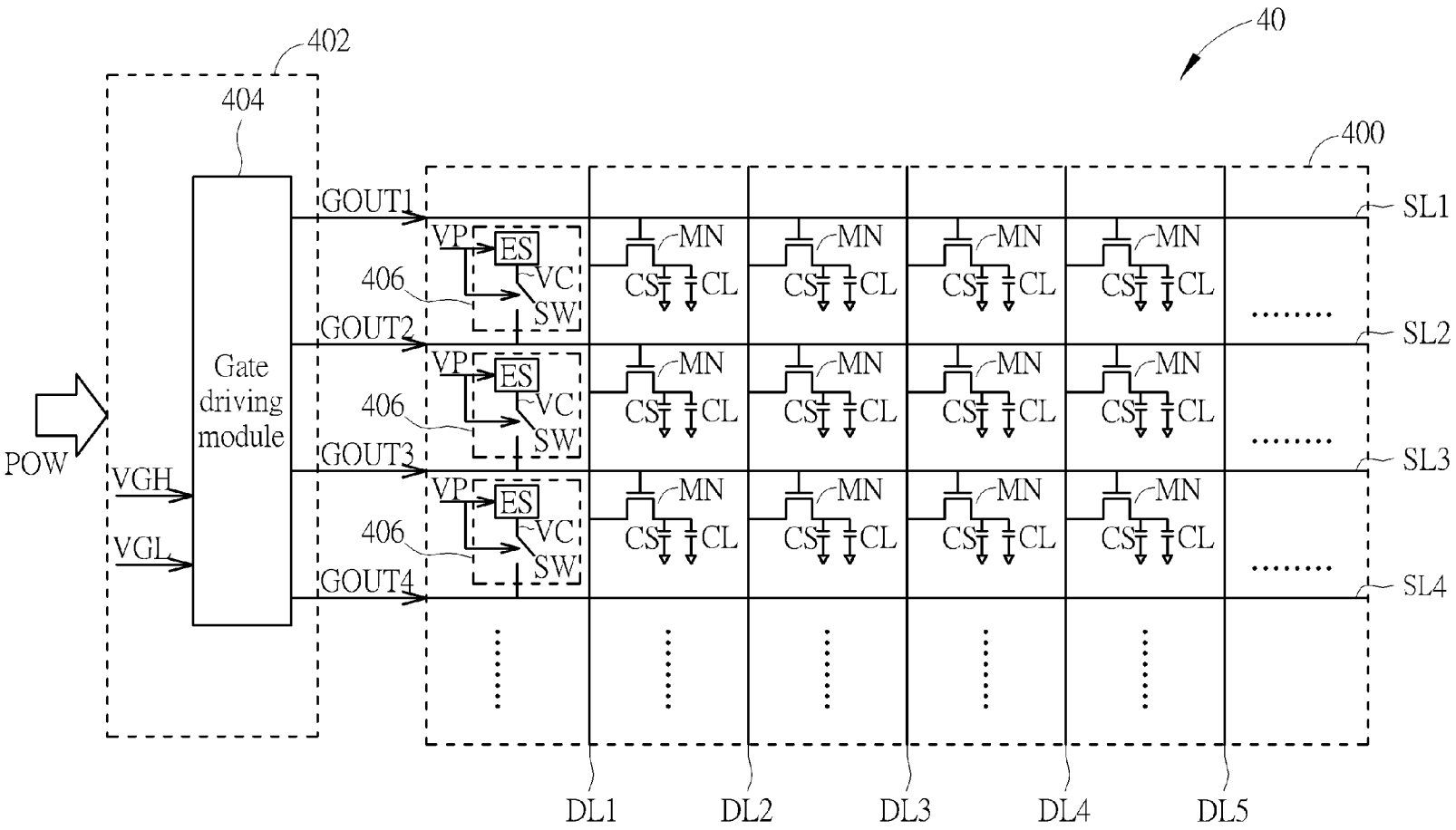
FIG. 4 is a schematic diagram of a display system according to another embodiment of the present invention.

Please refer to FIG. 4, which is a schematic diagram of a display system 40 according to an example of the present invention. The display system 40 may be an electronic product, such as a TFT LCD, a mobile phone, a laptop, or a tablet and the detailed structure of the display system 40 varies with different applications. The display system 40 is similar to the display system 10 shown in FIG. 1, thus the components and signals with the similar functions use the same symbols. As shown in FIG. 4, the display system 40 comprises a panel 400 and a driving device 402. In order to simplify illustrations, FIG. 4 only shows a gate driving module 404 and the components not directly related to the concept of the present invention (e.g. a source driving device, a voltage generating device, computing circuits and connection interfaces) are omitted. As shown in FIG. 4, the display system 40 is drove by a power POW. The panel 400 comprises scan lines SL1-SLn and data lines DL1-DLm. FIG. 4 shows the scan lines SL1-SL4 and the data lines DL1-DL5 for illustrations. Each of intersections between the scan lines SL1-SLn and the data lines DL1-DLm equips a transistor MN which is coupled to one of the scan lines SL1-SLn, one of the data lines DL1-DLm and capacitors CS and CL. The capacitor CL may be an equivalent capacitor of a display component, such as a liquid crystal molecule. The operation principle of the panel 400 should be well-known to those with ordinary skill in the art, and is not described herein for brevity.

Different from the display system 10 shown in FIG. 1, a discharging control module 406 is configured in the panel 400. As shown in FIG. 4, the panel 400 comprises a plurality of discharging control modules 406 and each of the plurality of discharging control modules 406 is coupled to one of the scan lines SL1-SLn. In the power-off period, wherein the display system 40 shuts down and the power POW is turned off, each of the plurality of discharging control modules 406 generates the raising voltage VR at one of the gate driving signals GOUT1-GOUTn, to conduct all of the transistors MN coupled to the scan lines SL1-SLn and to clear the voltages across the capacitors CS and CL. In other words, the plurality of discharging control module 406 generates a plurality of raising voltages VR on output paths of the gate driving signals GOUT1-GOUTn, to raise the voltage levels of the gate driving signals GOUT1-GOUTm and to conduct all of the transistors MN. Via adding the plurality of discharging control modules 406, the display system 40 clears the voltages across the capacitors CS and CL without additional signal lines. The number of signal lines among the circuits of the display system 40 is decreased and the complexity of signal line routing is lowered, therefore.

Figure 5:
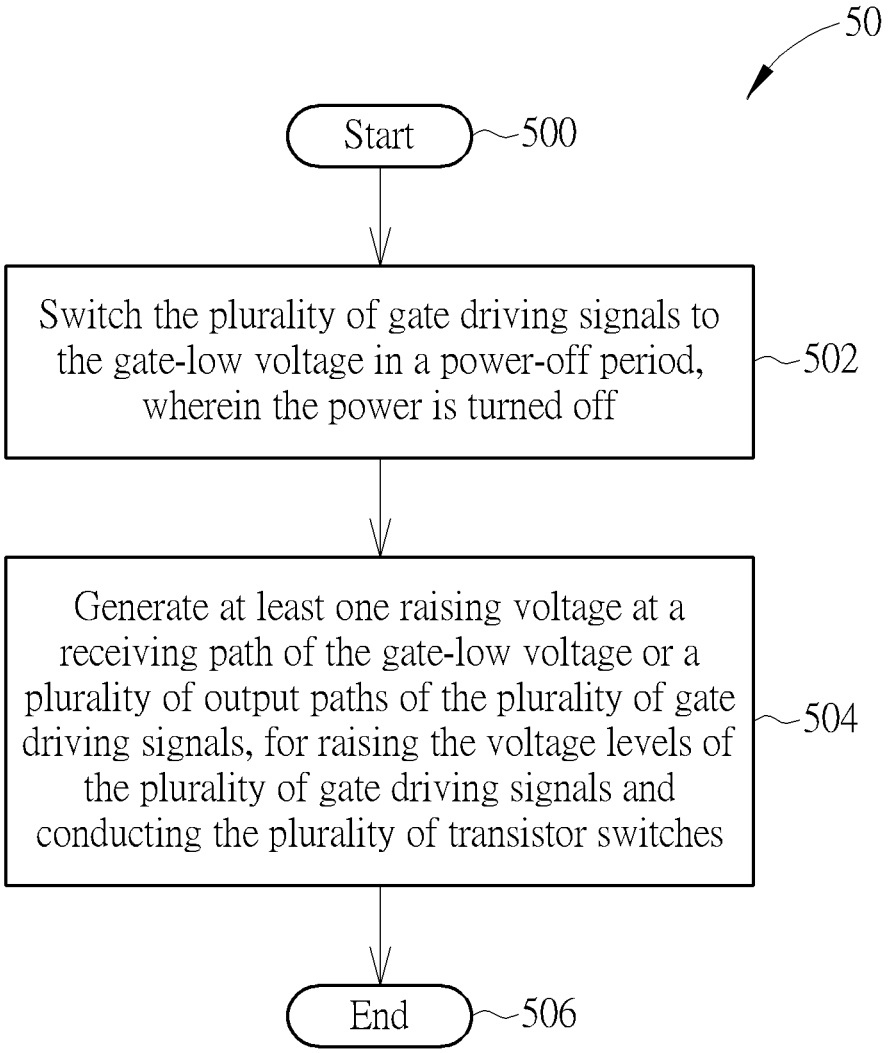
FIG. 5 is a flowchart of a discharging control method according to an embodiment of the present invention.

The method of the display system in the above embodiments clearing the images remaining on the panel can be summarized into a discharging control method 50 shown in FIG. 5. The discharging control method 50 may be utilized in a display system which is drove by a power and comprises a panel with a plurality of pixels and a gate driving module. In a normal operation period, wherein the power is turned on and the display system performs the normal operations, the gate driving module generates a plurality of gate driving signals according to a gate-high voltage and a gate-low voltage and switches the plurality of gate driving signals between the gate-high voltage and the gate low voltage to switch the conducting statuses of the plurality of transistor switches of the plurality of pixels. The discharging control method comprises:

Step 500: Start.

Step 502: Switch the plurality of gate driving signals to the gate-low voltage in a power-off period, wherein the power is turned off.

Step 504: Generate at least one raising voltage at a receiving path of the gate-low voltage or a plurality of output paths of the plurality of gate driving signals, for raising the voltage levels of the plurality of gate driving signals and conducting the plurality of transistor switches.

Step 506: End.

According to the discharging control method 50, the display system can clear the images remaining on the panel without additional signal lines. The number of signal lines among the circuits of the display system is decreased and the complexity of signal line routing is lowered, therefore. The detailed operations of the discharging control method 50 can be referred to the above, and are not described herein for brevity.

Figure 6:
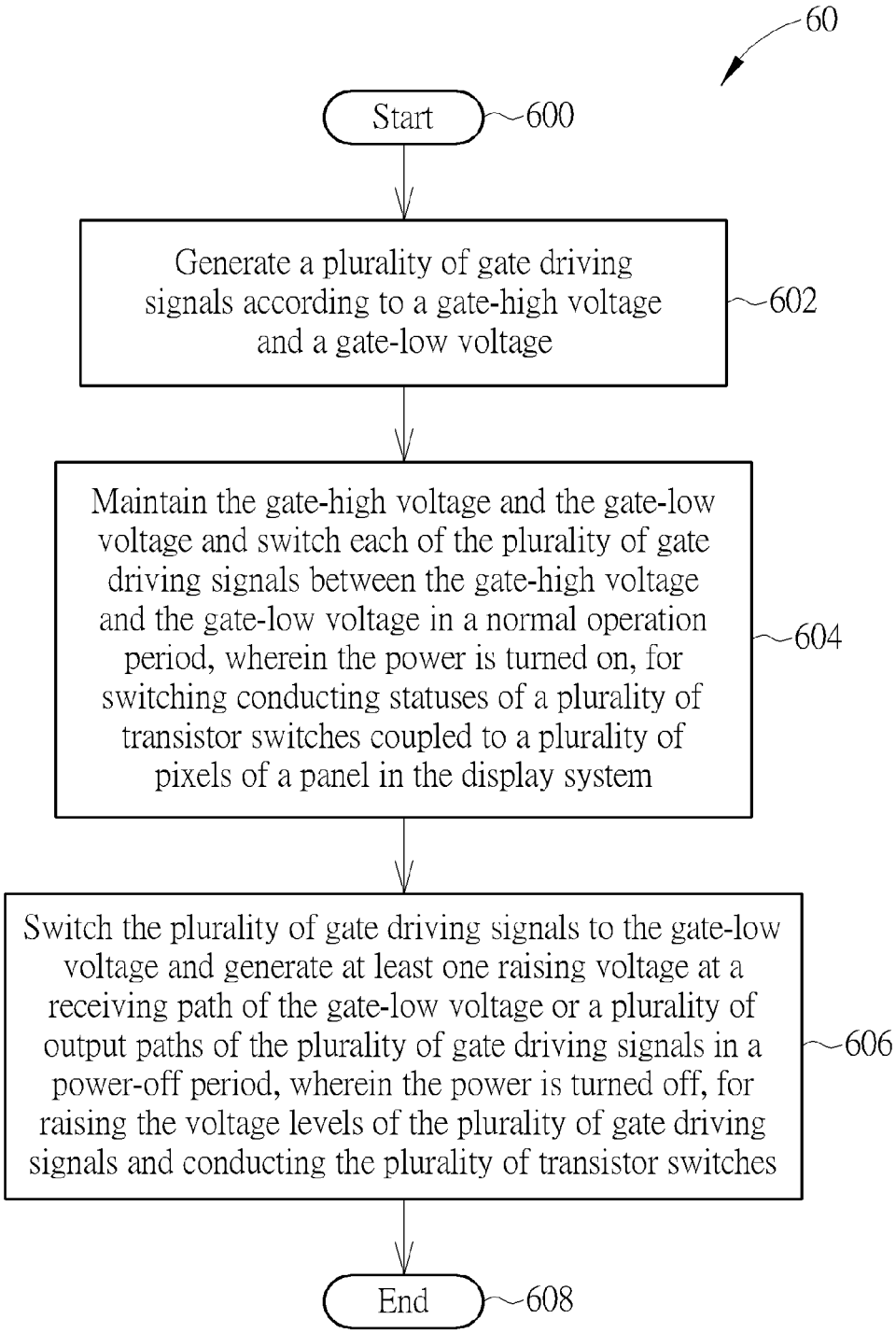
FIG. 6 is a flowchart of a driving method according to an embodiment of the present invention.

The method of the display system in the above embodiments clearing the images remaining on the panel can be summarized into a driving method 60 shown in FIG. 6. The driving method 60 is utilized in a display system which is drove by a power and comprises the following steps:

Step 600: Start.

Step 602: Generate a plurality of gate driving signals according to a gate-high voltage and a gate-low voltage.

Step 604: Maintain the gate-high voltage and the gate-low voltage and switch each of the plurality of gate driving signals between the gate-high voltage and the gate-low voltage in a normal operation period, wherein the power is turned on, for switching conducting statuses of a plurality of transistor switches coupled to a plurality of pixels of a panel in the display system.

Step 606: Switch the plurality of gate driving signals to the gate-low voltage and generate at least one raising voltage at a receiving path of the gate-low voltage or a plurality of output paths of the plurality of gate driving signals in a power-off period, wherein the power is turned off, for raising the voltage levels of the plurality of gate driving signals and conducting the plurality of transistor switches Step 608: End.

According to the driving method 60, the display system can clear the images remaining on the panel without additional signal lines. The number of signal lines among the circuits of the display system is decreased and the complexity of signal line routing is lowered, therefore. The detailed operations of the driving method 60 can be referred to the above, and are not described herein for brevity.

To sum up, the above embodiments utilize the charges, which is stored while the display system performs the normal operations, to conduct the transistors coupled to the scan lines when the display system shuts down and to clear the voltages across the display components and the image remaining on the panel of the display system. As a result, the display system clears the images remaining on the panel without additional signal lines. Therefore, the number of signal lines among the circuits of the display system is decreased and the complexity of signal line routing is lowered.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A discharging control method, for a display system, which comprises a panel with a plurality of pixels and a gate driving module wherein the gate driving module generates a plurality of gate driving signals according to a gate-high voltage and a gate-low voltage and the plurality of gate driving signals is switched between the gate-high voltage and the gate-low voltage in a normal operation period, wherein the display system is drove by a power, for switching the conducting statuses of a plurality of transistor switches coupled to the plurality of pixels, the discharging control method comprising:

switching the plurality of gate driving signals to the gate-low voltage in a power-off period, wherein the power is turned off; and generating at least one raising voltage at a receiving path of the gate-low voltage or a plurality of output paths of the plurality of gate driving signals, for raising the voltage levels of the plurality of gate driving signals and conducting the plurality of transistor switches.

2. A driving method for a display system, which is drove by a power, the driving method comprising:

generating a plurality of gate driving signals according to a gate-high voltage and a gate-low voltage;

maintaining the gate-high voltage and the gate-low voltage and switching each of the plurality of gate driving signals between the gate-high voltage and the gate-low voltage in a normal operation period, wherein the power is turned on, for switching conducting statuses of a plurality of transistor switches coupled to a plurality of pixels of a panel in the display system; and switching the plurality of gate driving signals to the gate-low voltage and generating at least one raising voltage at a receiving path of the gate-low voltage or a plurality of output paths of the plurality of gate driving signals in a power-off period, wherein the power is turned off, for raising the voltage levels of the plurality of gate driving signals and conducting the plurality of transistor switches.

3. A driving device, for a display system which is drove by a power, the driving device comprising:

a gate driving module, for generating a plurality of gate driving signals according to a gate-high voltage and a gate-low voltage, to control a plurality of transistor switches coupled to a plurality of pixels in a panel of the display system; and at least one discharging control module, wherein each discharging control module comprises:

an electricity storage unit, coupled between a positive voltage and a ground of the display system for generating a charging voltage; and a switch, coupled between the electricity storage unit and an output end of the discharging control module for switching a connection between the charging voltage and the output end according to the positive voltage, to generate a raising voltage on the plurality of gate driving signals.

4. The driving device of claim 3, wherein the gate driving module switches the plurality of gate driving signals to the gate-low voltage when the power is turned off.

5. The driving device of claim 3, wherein the driving device further comprises a source driving module and the at least one discharging control module is configured in the source driving module.

6. The driving device of claim 3, wherein the at least one discharging control module is configured in the gate driving module.

7. The driving device of claim 3, wherein the driving device further comprises a dc-dc converting module for outputting the gate-low voltage and the at least one discharging control module is configured in the gate driving module.

8. The driving device of claim 3, wherein the electricity storage unit comprises:

a diode, comprising an anode coupled to the positive voltage and a cathode; and a capacitor, coupled to the cathode of the diode and ground.

* * * * *